US006097920A

United States Patent [19]

Hara et al.

[11] Patent Number: 6,097,920

[45] Date of Patent: Aug. 1, 2000

[54] RECORDING APPARATUS AND METHOD INCLUDING INTERMEDIATE TRANSFER MEDIUM

[75] Inventors: Hidetoshi Hara; Jun Inagaki, both of Otsu, Japan

[73] Assignee: Toray Industries, Inc., Tokyo, Japan

[21] Appl. No.: 09/203,555

[22] Filed: Dec. 2, 1998

Related U.S. Application Data

[63] Continuation-in-part of application No. PCT/JP96/01497, Jun. 3, 1996.

[51] Int. Cl.[7] ..... G03G 15/01; G03G 15/16; G03G 15/20

[52] U.S. Cl. ..... 399/302; 399/307; 399/308

[58] Field of Search ..... 399/302, 308, 399/307

[56] References Cited

U.S. PATENT DOCUMENTS

| | | | |
|---|---|---|---|
| 4,430,412 | 2/1984 | Miwa et al. | 399/307 X |
| 4,515,460 | 5/1985 | Knechtel | 399/302 |
| 4,984,026 | 1/1991 | Nishise et al. | 399/302 |
| 5,534,984 | 7/1996 | Inoue | 399/308 |
| 5,612,773 | 3/1997 | Berkes et al. | 399/307 |
| 5,774,774 | 6/1998 | Tamura et al. | 399/302 |
| 6,016,417 | 1/2000 | Katsuno et al. | 399/308 |

FOREIGN PATENT DOCUMENTS

| | | |
|---|---|---|
| 4-119380 | 4/1992 | Japan . |
| 5-273800 | 10/1993 | Japan . |
| 6-175515 | 6/1994 | Japan . |
| 8-22202 | 1/1996 | Japan . |
| 8-30117 | 2/1996 | Japan . |
| 8-76553 | 3/1996 | Japan . |
| 8-185061 | 7/1996 | Japan . |

*Primary Examiner*—Susan S. Y. Lee
*Attorney, Agent, or Firm*—Morgan, Lewis & Bockius LLP

[57] ABSTRACT

An electrographic printing apparatus and method obtain high-quality images without the occurrence of transfer non-uniformity when toner images are transferred from a latent image carrier to an intermediate transfer medium. The apparatus and method record a toner image present on the latent image carrier by transferring and fixing the toner image to a recording medium via the intermediate transfer medium having an elastic layer on a surface thereof. The printing apparatus has a tensile spring for pressing the intermediate transfer medium against the latent image carrier, and the pressing force of the tensile spring is set so that the straightness in the width direction on the surface of the elastic layer is not larger than the height of the toner image.

30 Claims, 4 Drawing Sheets

RECORDING APPARATUS AND METHOD INCLUDING INTERMEDIATE TRANSFER MEDIUM

This is a continuation-in-part application of PCT International Application number PCT/JP96/01497 filed Jun. 3, 1996 designating the United States for the national phase.

TECHNICAL FIELD

The present invention relates to a recording apparatus and method for recording toner images developed on a latent image carrier on a recording medium via an intermediate transfer medium.

BACKGROUND ART

Some of recording apparatuses, for example, electrophotographic printers use an intermediate transfer drum (intermediate transfer medium) for the purpose of color printing. The intermediate transfer drum is usually formed with a conductive rubber layer on the surface of a metallic drum, so that the surface of the drum is not flat, having small irregularities of about several tens of microns.

Generally, the intermediate transfer drum is pressed against a photosensitive drum (latent image carrier), and toner images developed on the photosensitive drum are transferred to the intermediate transfer drum, so that the intermediate transfer drum must be in line contact with the photosensitive drum in the width direction.

However, if the intermediate transfer drum has small irregularities on the surface of the rubber layer thereof, a non-contact portion is produced between the photosensitive drum and intermediate transfer drum, so that the contact in the width direction consists partially of point contact. If such point contact occurs, the toner image is not transferred from the photosensitive drum to the intermediate transfer drum at the non-contact portion where the photosensitive drum is not in contact with the intermediate transfer drum, that is, transfer nonuniformity occurs. Therefore, there arises a problem in that the image quality of the resultant color print decreases remarkably.

If the intermediate transfer drum is pressed against the photosensitive transfer drum with a high pressing force, such point contact can be averted by the elastic deformation of the rubber layer.

However, if the pressing force is too great, the photosensitive layer consisting of an organic photoconductor (OPC) formed on the surface of the photosensitive drum deteriorates, or a dot tailing phenomenon such that the toner image transferred to the intermediate transfer drum collapses occurs. Therefore, there arises a problem of decrease in quality of the resultant image or other problems.

The present invention was made in view of the above situation, and accordingly an object thereof is to provide a recording apparatus and method in which high-quality images can be obtained without the occurrence of transfer nonuniformity when toner images are transferred from the latent image carrier to the intermediate transfer medium.

DISCLOSURE OF THE INVENTION

To achieve the above object, according to the recording apparatus defined in an aspect of the present invention, in a recording apparatus for recording a toner image on a latent image carrier by transferring and fixing the same to a recording medium via an intermediate transfer medium having an elastic layer on the surface thereof, the apparatus includes means for pressing the intermediate transfer medium against the latent image carrier, and the pressing force of the pressing means is set so that the straightness in the width direction on the surface of the elastic layer is not larger than the height of the toner image.

Also, to achieve the above object, according to the recording apparatus defined in another aspect of the present invention, in a recording apparatus for recording a toner image on a latent image carrier by transferring and fixing the same to a recording medium via an intermediate transfer medium having an elastic layer on the surface thereof, the apparatus includes means for pressing the intermediate transfer medium against the latent image carrier, and the pressing force of the pressing means is set so that the lowest portion of the surface of the elastic layer comes into contact with the toner image.

Further, to achieve the above object, according to the recording apparatus defined in yet another aspect of the present invention, in a recording apparatus for recording a plurality of toner images by transferring and fixing the same from at least one latent image carrier to a recording medium via an intermediate transfer medium having an elastic layer on the surface thereof, the apparatus includes means for pressing the intermediate transfer medium against the latent image carrier, and the pressing force of the pressing means is set so that the straightness in the width direction on the surface of said elastic layer is not larger than the height of the toner image when the first toner image is transferred from the latent image carrier to the intermediate transfer medium.

Still further, to achieve the above object, according to the recording apparatus defined in still another aspect of the present invention, in a recording apparatus for recording a plurality of toner images by transferring and fixing the same from at least one latent image carrier to a recording medium via an intermediate transfer medium having an elastic layer on the surface thereof, the apparatus includes means for pressing the intermediate transfer medium against the latent image carrier, and the pressing force of the pressing means is set so that the lowest portion of the surface of the elastic layer comes into contact with the toner image when the first toner image Is transferred from the latent image carrier to the intermediate transfer medium.

Preferably, the transfer and fixation of the toner image from the intermediate transfer medium to the recording medium are effected simultaneously.

Also preferably, the toner image Is developed by using a liquid toner.

Further preferably, the apparatus includes transfer bias applying means for assisting the transfer of the toner image from the latent image carrier to the intermediate transfer medium.

On the other hand, to achieve the above object, according to the recording method defined in a further aspect of the present invention, after a toner image on a latent image carrier is transferred to an intermediate transfer medium having an elastic layer on the surface thereof , the Intermediate transfer medium is pressed against the latent image carrier so that the straightness in the width direction on the surface of the elastic layer is not larger than the height of the toner image when the toner image is transferred and fixed to a recording medium for recording.

Also, to achieve the above object, according to the recording method defined in yet a further aspect of the present invention, after a toner image on a latent image carrier is transferred to an intermediate transfer medium having an elastic layer on the surface thereof, the intermediate transfer medium is pressed against the latent image carrier so that the lowest portion of the surface of the elastic layer comes into contact with the toner image when the toner image is transferred and fixed to a recording medium for recording.

Further, to achieve the above object, according to the recording method defined in still a further aspect of the present invention, after a plurality of toner images are transferred from at least one latent image carrier to an intermediate transfer medium having an elastic layer on the surface thereof, the intermediate transfer medium is pressed against the latent image carrier so that the straightness in the width direction on the surface of the elastic layer is not larger than the height of the toner image in the transfer of the first toner image from the latent image carrier to the intermediate transfer medium when the toner images are transferred and fixed to a recording medium for recording.

Still further, to achieve the above object, according to the recording method defined in a find aspect of the present invention, after a plurality of toner images are transferred from at least one latent image carrier to an intermediate transfer medium having an elastic layer on the surface thereof, the intermediate transfer medium is pressed against the latent image carrier so that the lowest portion of the surface of the elastic layer comes into contact with the toner image in the transfer of the first toner image from the latent image carrier to the intermediate transfer medium when the toner images are transferred and fixed to a recording medium for recording.

Preferably, the transfer and fixation of the toner image from the intermediate transfer medium to the recording medium are effected simultaneously.

Also preferably, the toner image is developed by using a liquid toner.

Further preferably, a transfer bias is applied to assist the transfer of the toner image from the latent image carrier to the intermediate transfer medium.

When the pressing force of the pressing means for pressing the intermediate transfer medium against the latent image carrier is set so that the straightness in the width direction on the surface of the elastic layer is not larger than the height of the toner image, or so that the lowest portion of the surface of the elastic layer comes into contact with the toner image, or so that either of the above conditions is met in the transfer of the first toner image from the latent image carrier to the intermediate transfer medium, even if the intermediate transfer medium partially comes into point contact with the latent image carrier, there is no problem in that the toner image is not transferred, resulting in transfer nonuniformity when the toner image is transferred from the latent image carrier to the intermediate transfer medium.

In this specification, the straightness in the width direction on the surface of the elastic layer means a distance between the highest portion and the lowest portion of irregularities in the width direction in an effective printing area of the elastic layer formed on the surface of the intermediate transfer medium.

By pressing the intermediate transfer medium against the latent image carrier under the above condition, the toner image comes into contact with the lowest portion of the elastic layer on the surface of the intermediate transfer medium, so that it becomes difficult for transfer nonuniformity such as a void to occur. In particular, for the recording apparatus in which the toner images are developed by using a liquid toner, the meeting of above condition is useful for preventing the transfer nonuniformity of toner image.

In order to surely transfer the toner image from the latent image carrier to the intermediate transfer medium, a transfer bias should preferably be applied so that the toner image is subjected to a force directed from the latent image carrier to the intermediate transfer medium.

Also, when the recording apparatus is so designed that a plurality of toner images are superposed on the intermediate transfer medium to form a color toner image and these toner images are transferred and fixed to the recording medium, the object of the present invention can be achieved by meeting the above condition in the transfer of the first toner image to be transferred to the intermediate transfer medium. The reason for this is that when a toner image is further transferred onto the toner image which has already been transferred to the intermediate transfer medium, the toner image at the highest portion of the elastic layer is compressed more than that at the lowest portion. Needless to say, it is better to meet the above condition for each transfer.

To check whether the above condition is met, the method as described below is used.

First, a monochromatic solid toner image is formed on the latent image carrier.

Next, this toner image is transferred to the intermediate transfer medium. At this time, an electric field which assists or hinders the transfer must not be substantially present between the latent image carrier and the intermediate transfer medium. This is achieved by making the surface and vicinity of the intermediate transfer medium in an electrically floating state, or by giving almost the same potential as that on the latent image carrier surface on which a solid toner image is formed to the intermediate transfer medium surface.

Subsequently, the toner image on the intermediate transfer medium is transferred and fixed to the recording medium.

A solid monochromatic image is formed on, for example, five copies of recording media under the same condition by the above-mentioned method, and the images on the recording media are compared. If a void (a portion where the toner image is not transferred) occurs at the same place in the image area with high reproducibility, there is a portion with which the toner image is not in contact on the elastic layer of the intermediate transfer medium surface. Inversely, if a void does not occur, or if, though it occurs, the position of the portion where it occurs has no reproducibility, there is no portion with which the toner image is not in contact on the intermediate transfer medium. In such a case, it is difficult for transfer nonuniformity to occur, so that the object of the present invention can be achieved.

If a void of a degree such that the occurrence position has no reproducibility occurs under the above measurement condition, high-quality images with less transfer nonuniformity can be obtained in actual printing, for example, by applying an appropriate transfer bias. Needless to say, it is better that no void always occur. In this case, high-quality images can be obtained without means such as transfer bias.

BEST MODE OF CARRYING OUT THE INVENTION

Figure 1:
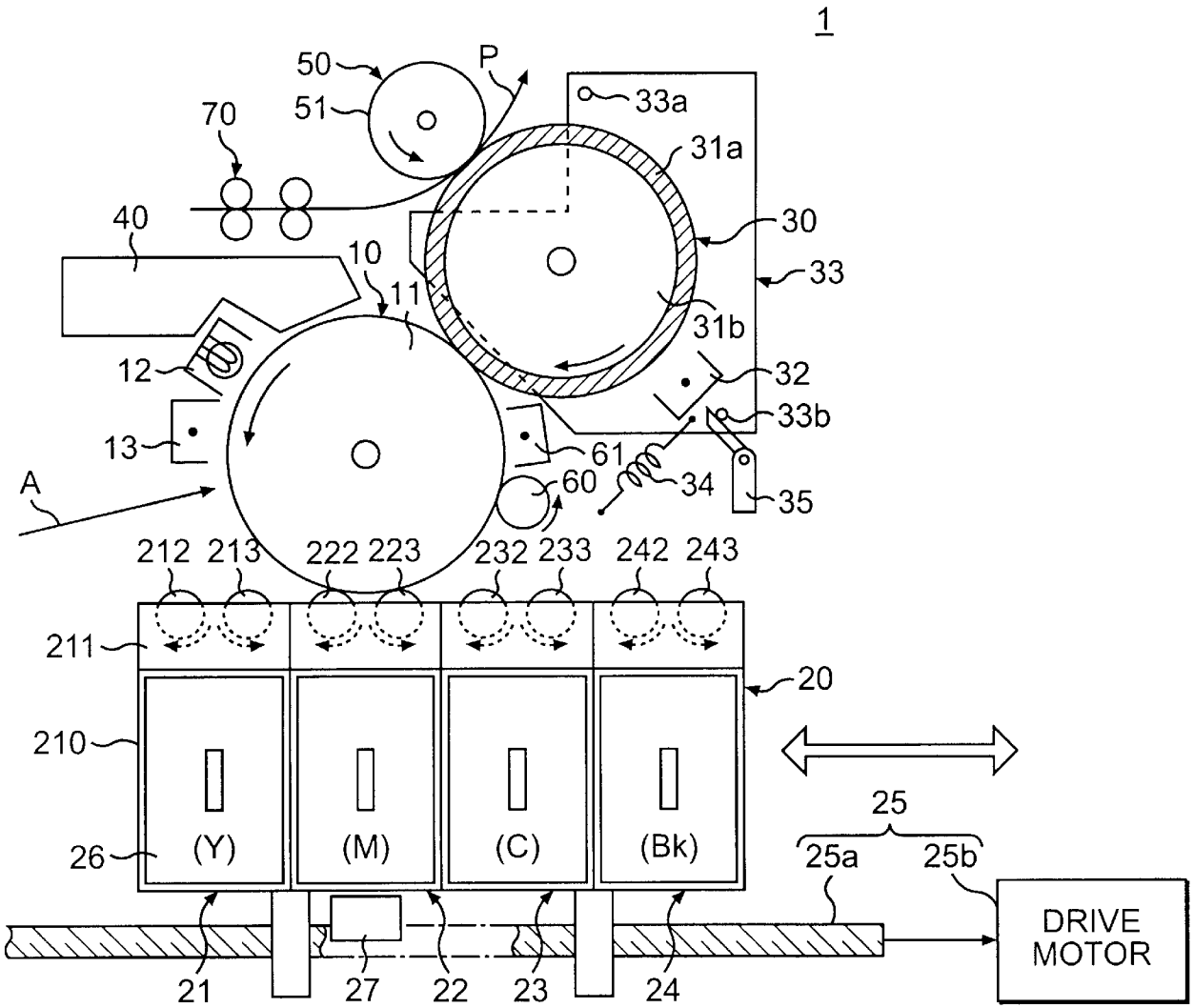
FIG. 1 is a front view of an electrophotographic printer, illustrating one embodiment of the recording apparatus and method in accordance with the present invention.

One embodiment of a recording apparatus and method in accordance with the present invention will be described in detail with reference to FIGS. 1 to 3.

First, the general construction of an electrophotographic printer relating to the recording apparatus of the present invention will be described with reference to FIG. 1. The electrophotographic printer 1 comprises photosensitive means 10, pre-transfer charging means 61, development means 20, intermediate transfer means 30, cleaning means 40, transfer means 50, auxiliary squeeze roller 60, paper supply device 70, and exposure system (not shown) etc. which radiates light for exposure from the direction of arrow A. The arrows in FIG. 1 indicate the direction of rotation or movement of each element.

The photosensitive means 10 has a photosensitive drum 11, a discharger 12 for removing the residual charge of the photosensitive drum 11, and a charger 13 for uniformly charging the photosensitive drum 11. Before the residual charge is removed, the surface of the photosensitive drum 11 is cleaned by the cleaning means 40. The cleaning means 40, discharger 12, and charger 13 are arranged between the intermediate transfer means 30 and the development means 20 in the named order along the rotation direction of the photosensitive drum 11.

The photosensitive drum 11 is formed with a photosensitive layer made of an organic photoconductor (OPC) on the surface of a cylindrical drum. Besides the OPC, for example, selenium (Se), amorphous silicon (α-Si), etc. can be used as the material for the photosensitive layer. Note that the photosensitive drum can be replaced with a photosensitive belt. The discharger 12, which is an LED alley or a miniature incandescent lamp, radiates light to the surface of the photosensitive drum 11 to erase the residual latent image. The charger 13 uniformly charges the photosensitive drum 11 by means of ions produced by corona discharge.

The exposure system, which forms electrostatic latent images on the surface of the photosensitive drum 11, has a laser beam source, liquid crystal shutter, etc. It radiates laser beams onto the photosensitive drum 11 from the direction of arrow A on the basis of the print information corresponding to each hue of a color manuscript to form an electrostatic latent image corresponding to the print information on the surface. An LED alley may be used as the exposure means for radiating print information onto the photosensitive drum 11.

The development means 20 has a first development unit 21 to a fourth development unit 24, driving means 25 for horizontally moving the development units 21 to 24 as a unit to right and left in FIG. 1, and toner cartridges 26 which are disposed in the development units 21 to 24 and can freely be attached to and detached from a housing 210. The driving means 25 has a ball screw 25*a* and a drive motor 25*b*. Although the details of the development units are described later, since each development unit is configured in the same way, the corresponding reference numerals are applied to the corresponding elements in the figure for other development units, and the detailed explanation is omitted. The first development unit 21 is formed with a liquid tank 211 for liquid toner at the upper part of the housing 210, and contains a toner cartridge 26 containing liquid toner of each hue at the lower part of the housing 210. The liquid tank 211 has a development roller 212 and a squeeze roller 213 arranged in parallel at a predetermined interval.

The development means 20 has the toner cartridges 26 containing liquid toner of yellow (Y), magenta (M), cyan (C), and black (Bk), which are disposed in the respective development units 21 to 24. At the initial position before the start of development, the development means 20 is positioned to the right of the photosensitive drum 11. During development, the development means 20 is moved successively to the photosensitive means 10 side in the order of the development unit 21, development unit 22, development unit 23, and development unit 24 by the driving means 25, by which each electrostatic latent image formed corresponding to each hue is developed successively. The liquid toner having toner particles of yellow, magenta, cyan, etc. dispersed in respective liquid carriers is used.

In this embodiment, a reversal development system which uses the toner of the same charging polarity as the polarity of charging by the charger 13. Therefore, the toner particles accumulate at a portion which is uniformly charged by the charger 13 and then exposed by the exposure means (an area where the absolute value of potential is lower than that of the non-exposed portion) of the surface of the photosensitive drum 11.

The pre-transfer charging means 61, which is a corona charger, charges the surface of the photosensitive drum 11 to the same polarity as that of the toner image, together with the developed toner image. By this pre-transfer charging, the toner image is pressed against the surface of the photosensitive drum 11 by an electric field force, so that the attractive force between the toner image and the photosensitive drum 11 increases. Thereupon, the flow and thickening of toner image is prevented in the process in which the toner image is transferred to the intermediate transfer drum 31, and the quantity of liquid carrier transferred to the intermediate transfer drum 31 together with the toner image is decreased (squeeze effect). At the same time, the surface of the photosensitive drum 11 is charged to the same polarity as that of the toner image, so that the transfer bias of toner image to the intermediate transfer drum 31 can be given.

The intermediate transfer means 30 has an intermediate transfer drum 31 and a charger 32 arranged along the rotation direction of the intermediate transfer drum 31, and the toner images developed successively by the development means 20 are transferred in layers onto the intermediate transfer drum 31 successively.

The intermediate transfer drum 31 is constructed by forming a thin elastic layer 31a (see FIGS. 2A and 2B) made of, for example, silicone resin, silicone rubber, fluororubber, NBR, etc. on the surface of a cylindrical metallic drum. It is pressed under pressure against the photosensitive drum 11, and the toner images are transferred in layers successively each time the toner image of each hue is developed by the development means 20. The intermediate transfer drum 31 of an appropriate diameter can be used according to the size of recording medium. Although the diameter of the intermediate transfer drum 31 is the same as that of the photosensitive drum 11 in this embodiment, it becomes larger than the diameter of the photosensitive drum 11 when a large recording medium is used. Note that the intermediate transfer drum can be replaced with an intermediate transfer belt.

Voltage applying means (not shown) is connected to the intermediate transfer drum 31. If necessary in printing, a potential of a polarity reverse to that of the toner particles is applied to the intermediate transfer drum 31, by which the transfer bias of toner image from the photosensitive drum 11 can be produced. Basically, the toner image is transferred electrostatically by a relative difference between the potential of the toner image and the surface potential of the intermediate transfer drum 31 at the contact portion between the photosensitive drum 11 and the intermediate transfer drum 31, so that an electric field in the direction such that the toner images are transferred to the intermediate transfer drum 31 should be generated. Preferably, a potential difference higher than 200 V, more preferably, higher than 500 V should be generated.

The charger 32 charges the intermediate transfer drum 31 to the same polarity as that of toner image on the same principle as that of the charger 13 for the photosensitive means 10. Thereupon, the charger 32 serves so that the influence of the previous toner image is canceled and the next toner image with different hue, which is transferred from the photosensitive drum 11, can easily be transferred to the intermediate transfer drum 31, and at the same time prevents the toner image already transferred to the intermediate transfer drum 31 from returning onto the photosensitive drum 11. Although the polarity of charging by the charger 32 is the same as that of the toner image, the charging polarity may be reverse to the polarity of toner image under the condition that the toner image already transferred to the intermediate transfer drum 31 does not return to the photosensitive drum 11. In particular, in a state in which no toner image exists on the intermediate transfer drum 31 such as in the case of a monochromatic printer, a transfer bias can sometimes be provided by charging the surface of the intermediate transfer drum 31 to the polarity reverse to that of toner image by using the charger 32.

The intermediate transfer drum 31 is rotatably supported substantially at the center of a support plate 33 whose upper end is rotatably attached to a housing (not shown) via a support shaft 33a, and pressed against the photosensitive drum 11 with a predetermined pressing force by a spring force of a tensile spring 34 one end of which is fixed to the housing and the other end of which is fixed to the lower end of the support plate 33. The intermediate transfer drum 31 is brought into contact with and separated from the photosensitive drum 11 by turning a lever 35 whose tip end is locked by a locking pin 33b provided at the lower part of the support plate 33.

Figure 2A:
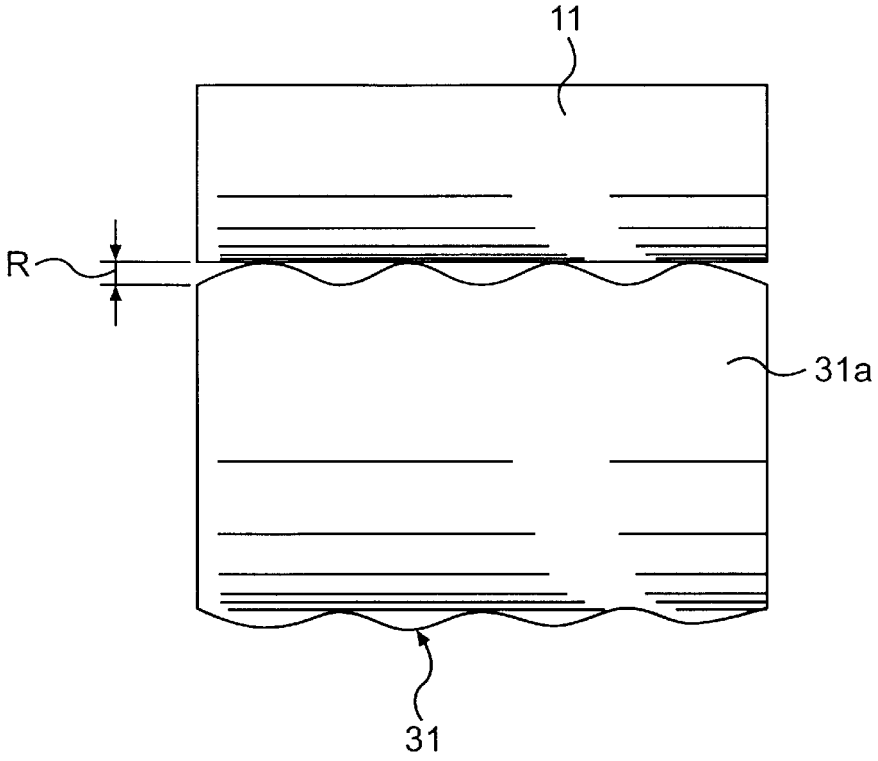
FIGS. 2A and 2B are side views illustrating the straightness in the width direction on the elastic layer surface formed on the intermediate transfer drum.
Figure 2B:
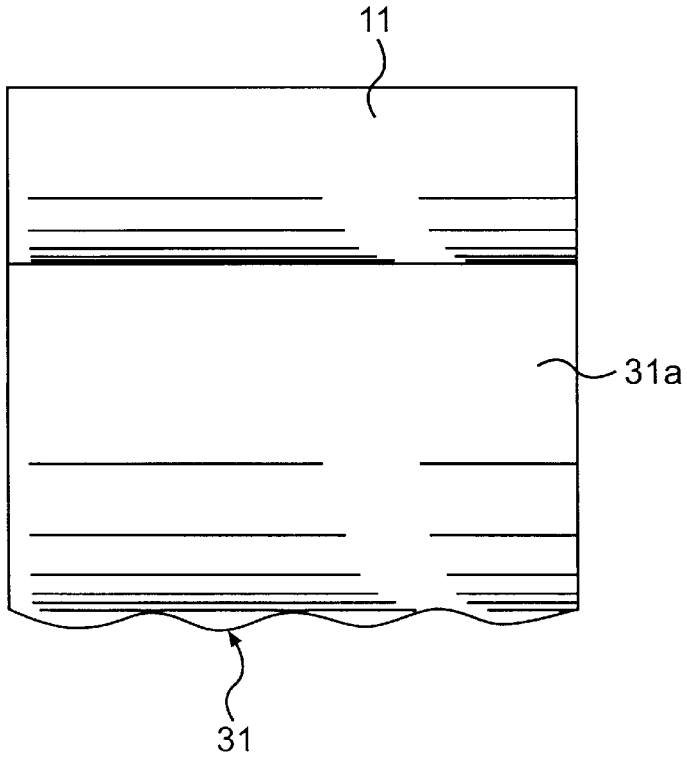
Figure 2C:
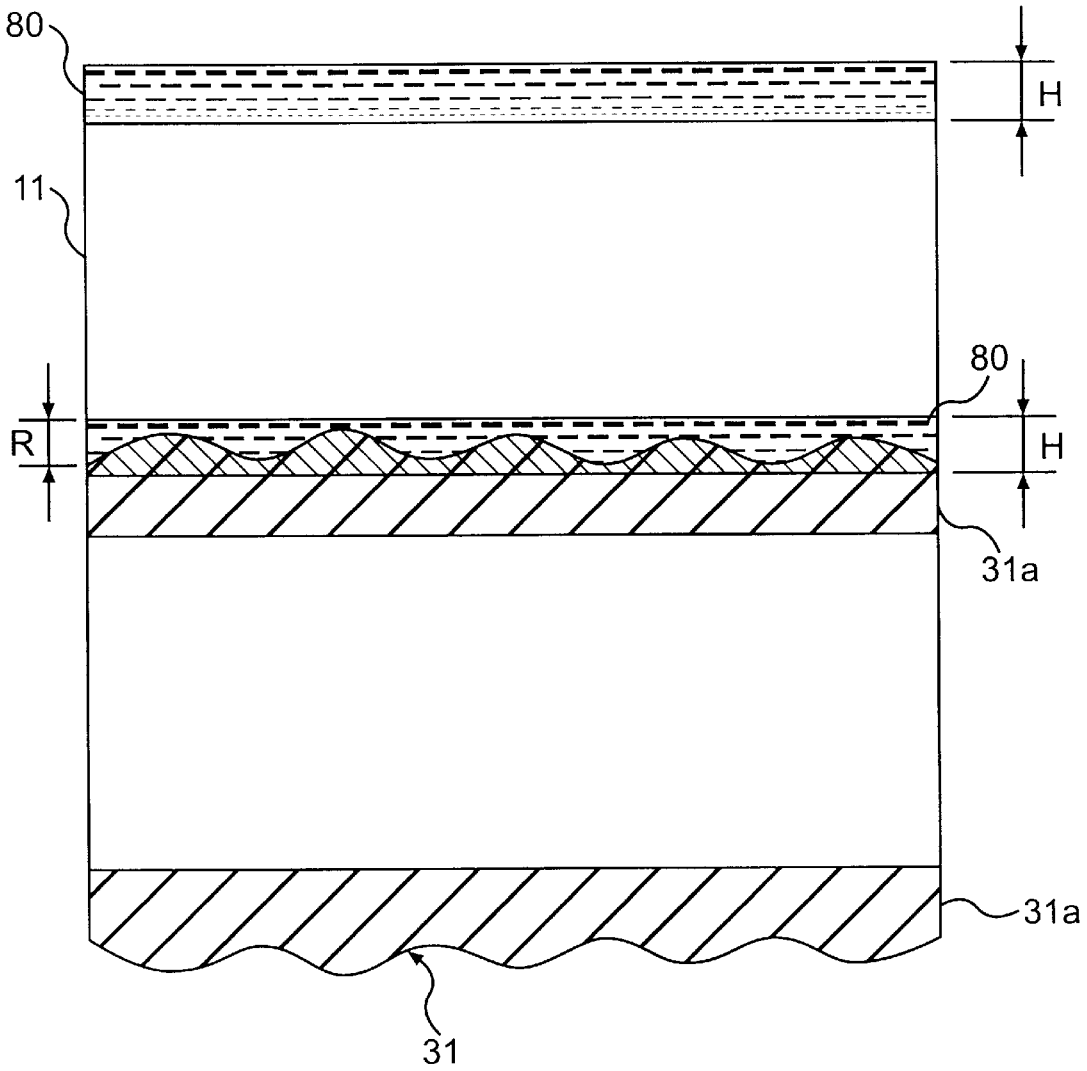
FIG. 2C is a cross-sectional view illustrating the straightness in the width direction on the elastic layer surface formed on the intermediate transfer drum and the height of the toner image.
Figure 3:
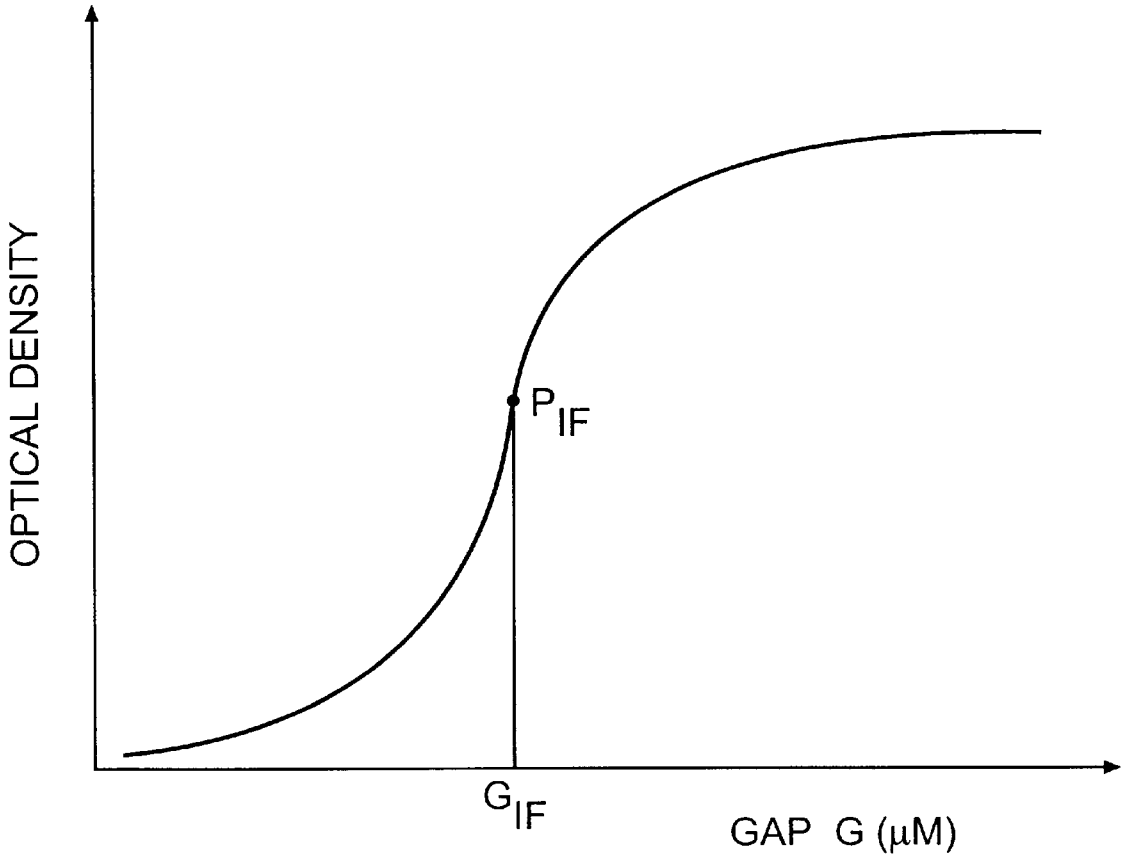
FIG. 3 is a density-gap characteristic curve showing the relationship between the optical density of printed solid image and the gap between a roller rotating in the direction opposite to the photosensitive drum and the photosensitive drum.

The pressing force of the tensile spring 34 is set so that as shown in FIG. 2A and 2C, the straightness R indicating the distance between the highest portion and the lowest portion in the width direction on the surface of the elastic layer 31*a* of the intermediate transfer drum 31 is not larger than the height of toner image 80 developed on the photosensitive drum 11. Also, the pressing force of the tensile spring 34 may be set so that the lowest portion of the surface of the elastic layer 31*a* comes into contact with the toner image. Further, the pressing force of the tensile spring 34 may be set so that either of the above-mentioned conditions is met when the first toner image is transferred from the photosensitive drum 11 to the intermediate transfer drum 31. This pressing force is set as described above because as shown in FIG. 2B, it is ideal that the elastic layer 31*a* is brought into close contact with the whole surface of the photosensitive drum 11 by elastic deformation, but it is difficult to achieve this close contact and the pressing force cannot be determined sweepingly depending on the material used for the elastic layer 31*a*.

The transfer of color toner images to recording paper P and the fixation thereto can be performed by separate steps. For example, the back surface of the recording paper P is charged to the polarity reverse to that of toner image by a corona charger etc. to transfer the toner image to the recording paper P, and subsequently the fixation may be performed by passing the recording paper P through a nip portion formed by a pair of hot rollers.

In the intermediate transfer means 30, the toner images developed on the photosensitive drum 11 are transferred in layers successively to the intermediate transfer drum 31. On this transfer, small amounts of toner image and liquid toner which have not been transferred to the intermediate transfer drum 31 remains on the photosensitive drum 11. However, these are cleaned by the cleaning means 40.

The cleaning means 40 is provided with a nonwoven fabric cloth and a cleaning blade in a cartridge thereof. When the cleaning means 40 is mounted to the electrophotographic printer 1, the cleaning blade comes into contact with the photosensitive drum 11. This cleaning means 40 is designed so that the cleaning blade scrapes up the toner image and residual liquid toner remaining on the photosensitive drum 11 after the transfer to the intermediate transfer drum 31, and the nonwoven fabric cloth wipes them off for cleaning.

The transfer means 50 has a heating roll 51 incorporating a heater (not shown) and a pressing mechanism (not shown). The heating roll 51 is pressed against the intermediate transfer drum 31 by the pressing mechanism so as to heat and pressurize the color toner images transferred in layers to the intermediate transfer drum 31 to fix them to the recording paper P.

When the toner images are transferred from the photosensitive drum 11 to the intermediate transfer drum 31, the pressing mechanism separates the heating roll 51 from the intermediate transfer drum 31. Before the transferred portion of the final toner image of four kinds of toner images reaches the transfer means 50, the heating roll 51 is pressed against the intermediate transfer drum 31 with a predetermined pressing force. Thus, the heating roll 51 pressurizes and heats the color toner images transferred in layers to the intermediate transfer drum 31, and simultaneously transfers and fixes them to the recording paper P supplied from the paper supply device 70.

The auxiliary squeeze roller 60, which is disposed between the development means 20 and the intermediate transfer means 30, removes excess liquid toner, especially liquid carrier, from the photosensitive drum 11 on which the toner image has been developed. The same effect can be achieved by employing a squeeze corona using a charger in place of the auxiliary squeeze roller 60.

The paper supply device 70 supplies the recording paper P between the intermediate transfer drum 31 and the heating roll 50 when the toner images formed in layers on the intermediate transfer drum 31 are fixed.

The electrophotographic printer 1 in accordance with the present invention is configured as described above, and produces color images by the recording method described below.

First, the residual charges are removed by the discharger 12 from the surface of the photosensitive drum 11 which has been cleaned by the cleaning means 40, and the photosensitive drum 11 is charged uniformly by the charger 13.

Then, laser beams are radiated as indicated by arrow A in FIG. 1 to successively form electrostatic latent images corresponding to the print information on the surface of the photosensitive drum 11. The electrostatic latent images formed by the radiation of laser beams are formed a total of four times corresponding to hues of yellow, magenta, cyan, and black.

Next, the ball screw 25*a* is rotated by the drive motor 25*b*, by which the development means 20, which has been positioned at the right of the photosensitive drum 11 in the figure, is moved horizontally toward the photosensitive drum 11. The yellow toner image is developed by the first development unit 21, the magenta toner image by the second development unit 22, and similarly the cyan and black toner images are developed successively. Thus, the toner images developed by the development units are successively transferred to the intermediate transfer drum 31, and toner images of four colors are formed in layers on the intermediate transfer drum 31.

For the intermediate transfer drum 31, the pressing force acting on the photosensitive drum 11 by using the tensile spring 34 is set so that the straightness R in the width direction on the surface of the elastic layer 31*a* is not larger than the height of toner image developed on the photosensitive drum 11. Therefore, the toner image of each hue does not cause transfer nonuniformity when being transferred from the photosensitive drum 11 to the intermediate transfer drum 31.

In parallel with the transfer of toner image developed by the fourth development unit 24 to the intermediate transfer drum 31, the heating roll 51 is pressed against the intermediate transfer drum 31 by the pressing mechanism. Thus, the toner images of four colors transferred in layers to the intermediate transfer drum 31 are heated and pressurized to be collectively transferred and fixed to the recording paper P, completing one process for recording color images.

After the recording of toner images of the four colors onto the recording paper P is finished, the pressing of the heating roll 51 against the intermediate transfer drum 31 by the pressing mechanism is released, and the development means 20 is moved to the initial position at the right of the photosensitive drum 11 by the driving means 25.

The following table gives the check result based on the above-mentioned check method and transfer nonuniformity in ordinary printing (transfer bias is present) under various conditions of material hardness V of the elastic layer 31*a* of the intermediate transfer drum 31, straightness R (μm) when the intermediate transfer drum 31 is not pressed against the photosensitive drum 11, and toner image height H (μm) in the case where A3-size copy paper is used in the lengthwise direction in the electrophotographic printer 1. The pressing force for pressing the intermediate transfer drum 31 against the photosensitive drum 11 was set at 10 kgf (98N), and the pressing width was 320 mm.

| V (°) | R (μm) | H (μm) | Check result | Printing result |
|---|---|---|---|---|
| 60 | 40 | 30 | One 30 mm-dia void occurs in the center of image | A 25 mm-dia void occurs at the left-mentioned void portion |
| 40 | 40 | 30 | Many 0.5–1 mm-dia voids occur at the upper left part of image | Density nonuniformity, in which the optical density (OD) value decreases by about 0.2 as compared with the surroundings, occurs at a position substantially corresponding to the left-mentioned void portion. |
| 20 | 40 | 30 | No void occurs | Density nonuniformity is within 0.1 of OD value |
| 40 | 35 | 30 | No void occurs | Density nonuniformity is within 0.1 of OD value |
| 40 | 35 | 20 | One 20 mm-dia void occurs at the upper left part of image | A 10 mm-dia void occurs at the left-mentioned void portion |

The transfer bias in ordinary printing can be provided by using (1) a method in which the surface of the photosensitive drum 11 is charged to an absolute value of 800 V by the pre-transfer charger 61, and the voltage applying means of the intermediate transfer drum 31 is grounded, or (2) a method in which the pre-transfer charger 61 is not used, and the surface of the intermediate transfer drum 31 is charged to an absolute value of 800 V of polarity reverse to that of toner image by the aforesaid voltage applying means. As the method of preventing the generation of electric field which assists or hinders the transfer in checking, either of the following methods may be used in the case of the above (1): (a) a method in which the pre-transfer charger 61 is not used, (b) a method in which the surface of the intermediate transfer drum 31 is charged to 800 V of the same polarity as that of the photosensitive drum 11 by the charger 32, (c) a method in which the metallic drum of the intermediate transfer drum 31 is electrically floated, and other methods. In the case of above (2), the above (c) method, or, (d) a method in which the voltage applying means is grounded, or the like methods can be used. In the case of the above (d), the potential of the toner accumulating portion is only several tens of volts in the reversal development system, so that the presence of electric field which substantially assists the transfer of toner images can be prevented, and therefore there is no large difference in the results of the above checking.

The measurement methods for the above-mentioned parameters are as described below.

The hardness V (°) was measured on the basis of Shore hardness A. The elastic layer 31*a* of the intermediate transfer drum 31 was formed by laminating a silicone rubber layer of 1 μm thick on a fluororubber layer of 1 mm thick. The hardness was measured in this laminated state.

The straightness R was measured by a displacement profile when probe scanning was performed in the axial direction of the intermediate transfer drum 31 by using a three-dimensional measuring equipment, laser displacement meter, etc.

For measurement of the toner image height H, a roller was disposed which was located at a position just before the transfer from the photosensitive drum 11 to the intermediate transfer drum 31, like the auxiliary squeeze roller 60, and rotated in the direction opposite to the photosensitive drum 11 from the viewpoint of surface travel velocity, with a predetermined gap with respect to the surface of the photosensitive drum 11. A potential of the same polarity as that of toner image on the photosensitive drum 11 was applied to this roller, and solid images were printed. The optical density of the resultant solid image was measured while changing the above-mentioned gap. As a result, it was found that the density usually changes with respect to the gap as shown in the characteristic curve of FIG. 3. The gap value GIF corresponding to the inflection point PIF of this characteristic curve was regarded as the toner image height H. The reason why the density decreases suddenly as the gap G decreases as shown in FIG. 3 is that the toner image is scraped off by the roller when the gap decreases.

In the above-described embodiment, a single latent image carrier is used as a color printer. In this case, the toner image of each color is formed successively on the latent image carrier, the toner image is transferred to the intermediate transfer medium each time the toner image is formed, the toner image of each color is superposed on the intermediate transfer medium, and finally the toner image is transferred to the recording medium. However, if the object of the present invention is achieved, for example, a plurality of latent image carriers may be used. In this case, a mode in which the toner image is formed on each of the latent image carriers, the toner image is transferred successively to a single intermediate transfer medium, and the toner image of each color is superposed on the intermediate transfer medium (what we call a tandem system), or a mode in which the toner image is transferred to the recording medium immediately each time the toner image is transferred to the intermediate transfer medium, the toner image is superposed on the recording medium, and finally the toner image is fixed may be used.

INDUSTRIAL APPLICABILITY

According to the recording apparatus and method of the present invention, the pressing force of the pressing means for pressing the intermediate transfer medium against the latent image carrier is set so that the straightness in the width direction on the elastic layer surface is not larger than the toner image height, or so that the lowest portion of the elastic layer surface is in contact with the toner image, or so that either of the above conditions is met when the first toner image is transferred from the latent image carrier to the intermediate transfer medium. Therefore, even if the intermediate transfer medium partially comes into point contact with the latent image carrier, transfer nonuniformity does not occur when the toner image is transferred from the latent image medium to the intermediate transfer medium, so that high-quality images can be obtained.

What is claimed is:

1. A recording apparatus for recording a toner image from a latent image carrier by transferring and fixing said toner image to a recording medium via an intermediate transfer medium having an elastic layer on a surface thereof, in which said apparatus includes means for pressing said intermediate transfer medium against said latent image carrier, and a pressing force of said pressing means is set so that straightness in a width direction on a surface of said elastic layer is not larger than a height of said toner image.

2. A recording apparatus for recording a toner image from a latent image carrier by transferring and fixing said toner image to a recording medium via an intermediate transfer medium having an elastic layer on a surface thereof, said elastic layer having a surface with high and low portions facing the latent image carrier, the high portions being closer to the latent image carrier than the lower portions, in which said apparatus includes means for pressing said intermediate transfer medium against said latent image carrier, and a pressing force of said pressing means is set so that a lowest portion of the low portions comes into contact with said toner image.

3. A recording apparatus for recording a plurality of toner images by transferring and fixing said plurality of toner images from at least one latent image carrier to a recording medium via an intermediate transfer medium having an elastic layer on a surface thereof, in which said apparatus includes means for pressing said intermediate transfer medium against said latent image carrier, and a pressing force of said pressing means is set so that straightness in a width direction on a surface of said elastic layer is not larger than a height of a first toner image of said plurality of toner images when the first toner image is transferred from said latent image carrier to said intermediate transfer medium.

4. A recording apparatus for recording a plurality of toner images by transferring and fixing said plurality of toner images from at least one latent image carrier to a recording medium via an intermediate transfer medium having an elastic layer on a surface thereof, said elastic layer having a surface with high and low portions facing the latent image carrier, the high portions being closer to the latent image carrier than the low portions, in which said apparatus includes means for pressing said intermediate transfer medium against said latent image carrier, and a pressing force of said pressing means is set so that a lowest portion of the low portions comes into contact with a first toner image of said plurality of toner images when the first toner image is transferred from said latent image carrier to said intermediate transfer medium.

5. The recording apparatus according to claim 1, wherein the transfer and fixation of said toner image from said intermediate transfer medium to said recording medium are effected simultaneously.

6. The recording apparatus according to claim 1, wherein said toner image is developed by using a liquid toner.

7. The recording apparatus according to claim 1, wherein said apparatus includes transfer bias applying means for assisting the transfer of said toner image from said latent image carrier to said intermediate transfer medium.

8. A recording method in which a toner image on a latent image carrier is transferred to an intermediate transfer medium having an elastic layer on a surface thereof while said intermediate transfer medium is pressed against said latent image carrier so that straightness in a width direction on a surface of said elastic layer is not larger than a height of said toner image, and said toner image is transferred and fixed to a recording medium for recording.

9. A recording method in which a toner image on a latent image carrier is transferred to an intermediate transfer medium having an elastic layer on a surface thereof, said elastic layer having a surface with high and low portions facing said latent image carrier, the high portions being closer to said latent image carrier than the low portions, while said intermediate transfer medium is pressed against said latent image carrier so that a lowest portion of the low portions comes into contact with said toner image, and said toner image is transferred and fixed to a recording medium for recording.

10. A recording method in which a plurality of toner images are transferred from at least one latent image carrier to an intermediate transfer medium having an elastic layer on a surface thereof while said intermediate transfer medium is pressed against said latent image carrier so that straightness in a width direction on a surface of said elastic layer is not larger than a height of a first toner image of said plurality of said toner images in the transfer of the first toner image from said latent image carrier to said intermediate transfer medium, and said toner images are transferred and fixed to a recording medium for recording.

11. A recording method in which a plurality of toner images are transferred from at least one latent image carrier to an intermediate transfer medium having an elastic layer on a surface thereof, said elastic layer having a surface with high and low portions facing said latent image carrier, the high portions being closer to said latent image carrier than the low portions, while said intermediate transfer medium is pressed against said latent image carrier so that a lowest portion of the low portions comes into contact with a first toner image of said plurality of toner images in the transfer of the first toner image from said latent image carrier to said intermediate transfer medium, and said plurality of toner images are transferred and fixed to a recording medium for recording.

12. The recording method according to claim 8, wherein the transfer and fixation of said toner image from said intermediate transfer medium to said recording medium are effected simultaneously.

13. The recording method according to claim 8, wherein said toner image is developed by using a liquid toner.

14. The recording method according to claim 8, wherein a transfer bias is applied to assist the transfer of said toner image from said latent image carrier to said intermediate transfer medium.

15. A recording apparatus for recording a toner image onto a recording medium, the recording apparatus comprising:

a latent image carrier;

an intermediate transfer medium having an elastic surface layer, said elastic surface layer coming into contact with said latent image carrier and the recording medium, the toner image being transferred and fixed from said latent image carrier to the recording medium via said intermediate transfer medium; and means for pressing said intermediate transfer medium against said latent image carrier with a pressing force, the pressing force being set so that straightness in a width direction on said elastic surface layer is not larger than a height of the toner image.

16. A recording apparatus for recording a toner image onto a recording medium, the recording apparatus comprising:

a latent image carrier;

an intermediate transfer medium having an elastic surface layer, said elastic surface layer having high and low portions facing said latent image carrier, the high portions being closer to said latent image carrier than the low portions, said elastic surface layer coming into contact with said latent image carrier and the recording medium, the toner image being transferred and fixed from said latent image carrier to the recording medium via said intermediate transfer medium; and means for pressing said intermediate transfer medium against said latent image carrier with a pressing force, the pressing force being set so that a lowest portion of the low portions of said elastic surface layer comes into contact with the toner image.

17. A recording apparatus for recording a plurality of toner images onto a recording medium, the recording apparatus comprising:

at least one latent image carrier;

an intermediate transfer medium having an elastic surface layer, said elastic surface layer coming into contact with said latent image carrier and the recording medium, the plurality of toner images being transferred and fixed from said latent image carrier to the recording medium via said intermediate transfer medium; and means for pressing said intermediate transfer medium against said latent image carrier with a pressing force, the pressing force being set so that straightness in a width direction on said elastic surface layer is not larger than a height of a first toner image of the plurality of toner images when transferred from said latent image carrier to said intermediate transfer medium.

18. A recording apparatus for recording a plurality of toner images onto a recording medium, the recording apparatus comprising:

at least one latent image carrier;

an intermediate transfer medium having an elastic surface layer, said elastic surface layer having high and low portions facing said latent image carrier, the high portions being closer to said latent image carrier than the low portions, said elastic surface layer coming into contact with said latent image carrier and the recording medium, the plurality of toner images being transferred and fixed from said latent image carrier to the recording medium via said intermediate transfer medium; and means for pressing said intermediate transfer medium against said latent image carrier with a pressing force, the pressing force being set so that a lowest portion of the low portions of said elastic layer comes into contact with a first toner image of the plurality of toner images when transferred from said latent image carrier to said intermediate transfer medium.

19. The recording apparatus according to claim 15, wherein the transfer and fixation of the toner image from said intermediate transfer medium to said recording medium are effected simultaneously.

20. The recording apparatus according to claim 15, wherein the toner image is developed by using a liquid toner.

21. The recording apparatus according to claim 15, wherein said apparatus includes transfer bias applying means for assisting the transfer of the toner image from said latent image carrier to said intermediate transfer medium.

22. A recording method for transferring a toner image from a latent image carrier to a recording medium, comprising the steps of:

transferring the toner image from the latent image carrier to an intermediate transfer medium having an elastic surface layer; while pressing the intermediate transfer medium against the latent image carrier so that straightness in a width direction on a surface of the elastic surface layer is not larger than a height of the toner image; and transferring and fixing the toner image from the intermediate transfer medium to the recording medium.

23. A recording method for transferring a toner image from a latent image carrier to a recording medium, comprising the steps of:

transferring the toner image from the latent image carrier to an intermediate transfer medium having an elastic surface layer, the elastic surface layer facing the latent image carrier and having high and low portions, the high portions being closer to the latent image carrier than the low portions; while pressing the intermediate transfer medium against the latent image carrier so that a lowest portion of the low portions of the elastic surface layer comes into contact with the toner image; and transferring and fixing the toner image from the intermediate transfer medium to the recording medium.

24. A recording method for transferring a plurality of toner images from at least one latent image carrier to a recording medium, comprising the steps of:

transferring the plurality of toner images from the latent image carrier to an intermediate transfer medium having an elastic surface layer; while pressing the intermediate transfer medium against the latent image carrier so that straightness in a width direction on the elastic surface layer is not larger than a height of a first toner image of the plurality of toner images; and transferring and fixing the plurality of toner images from the intermediate transfer medium to the recording medium.

25. A recording method for transferring a plurality of toner images from at least one latent image carrier to a recording medium, comprising the steps of:

transferring the plurality of toner images from the latent image carrier to an intermediate transfer medium having an elastic surface layer, the elastic surface layer facing the latent image carrier and having high and low portions, the high portions being closer to the latent image carrier than the low portions; while pressing the intermediate transfer medium against the latent image carrier so that a lowest portion of the low portions of the elastic surface layer comes into contact with the toner image; and transferring and fixing the plurality of toner images from the intermediate transfer medium to the recording medium.

26. The recording method according to claim 22, wherein the transfer and fixation of the toner image from the intermediate transfer medium to the recording medium occur simultaneously.

27. The recording method according to claim 22, wherein the toner image is developed by using a liquid toner.

28. The recording method according to claim 22, wherein a transfer bias is applied to assist the transfer of the toner image from the latent image carrier to said intermediate transfer medium.

29. A recording apparatus according to any of claims 2, 3, 4, 16, 17, or 18, wherein the toner image on said latent image carrier is transferred from said latent image carrier to said intermediate transfer medium utilizing a force exerted by an electric field and said pressing force, and then transferred from said intermediate transfer medium to said recording medium.

30. A recording method according to any of claims 9, 10, 11, 23, 24, or 25, wherein the toner image on said latent image carrier is transferred from said latent image carrier to said intermediate transfer medium utilizing a force exerted by an electric field and a pressing force, and then transferred from said intermediate transfer medium to said recording medium.

* * * * *